US006042184A

United States Patent [19]

Kofoed

[11] Patent Number: 6,042,184

[45] Date of Patent: Mar. 28, 2000

[54] FACE AND HEAD SUPPORTING DEVICE FOR USE WITH A LOUNGE CHAIR OR THE LIKE

[76] Inventor: Virginia C. Kofoed, 6567 S. Helena St., Aurora, Colo. 80016

[21] Appl. No.: 09/205,410

[22] Filed: Dec. 3, 1998

[51] Int. Cl.[7] ..... A47C 1/10; A47C 7/36; A61G 15/12

[52] U.S. Cl. ..... 297/391; 297/397; 297/900; 5/638

[58] Field of Search ..... 297/391, 394, 297/397, 900; 5/618, 638

[56] References Cited

U.S. PATENT DOCUMENTS

| | | | |
|---|---|---|---|
| D. 352,635 | 11/1994 | Yoder | 297/900 X |
| 3,382,510 | 5/1968 | Robinson . | |
| 3,388,407 | 6/1968 | Harris . | |
| 3,897,102 | 7/1975 | Lemaire | 297/900 X |
| 4,606,086 | 8/1986 | Rowland | 297/900 X |
| 4,779,297 | 10/1988 | Sturges | 5/638 X |
| 4,891,854 | 1/1990 | Finkelstein | 297/900 X |
| 4,941,222 | 7/1990 | Prager | 297/900 X |
| 5,121,969 | 6/1992 | Schroeder | 297/900 X |
| 5,177,823 | 1/1993 | Riach | 5/638 X |
| 5,222,779 | 6/1993 | Johnson | 5/638 X |
| 5,237,713 | 8/1993 | Prager | 297/900 X |
| 5,269,035 | 12/1993 | Hartunian | 5/638 |
| 5,297,850 | 3/1994 | Guleserian | 297/900 X |
| 5,347,668 | 9/1994 | Manning | 5/638 X |
| 5,466,039 | 11/1995 | Umbrianna | 297/900 X |
| 5,546,619 | 8/1996 | Braun | 5/638 |
| 5,586,351 | 12/1996 | Ive | 297/397 X |
| 5,615,432 | 4/1997 | Von Ohlen, III | 5/638 |
| 5,624,157 | 4/1997 | Kostuk | 297/900 X |
| 5,652,981 | 8/1997 | Singer-Leyton et al. | 5/638 X |
| 5,661,860 | 9/1997 | Heitz | 5/638 |
| 5,675,851 | 10/1997 | Feathers | 5/638 X |
| 5,678,894 | 10/1997 | Eley | 297/900 |
| 5,778,887 | 7/1998 | Curtiss | 5/638 X |
| 5,799,344 | 9/1998 | Sturges | 5/638 X |
| 5,829,080 | 11/1998 | Robillard et al. | 297/900 X |

*Primary Examiner*—Peter M. Cuomo
*Assistant Examiner*—Rodney B White
*Attorney, Agent, or Firm*—Ramon L. Pizarro; Donald W. Margolis; Edwin H. Crabtree

[57] ABSTRACT

A supporting device for supporting a person's head on a lounge chair is provided. The lounge chair has a support frame and webbing secured within the support frame. The supporting device includes a substantially flat base with the base having a first side surface and a second side surface opposite the first side surface. The base also includes an aperture through the first side surface and the second side surface opposite the first side surface, with the aperture being sized and shaped to allow passage of a major portion of the user's head therethrough. A cushioned pillow is positioned adjacent the first side surface of the base with the cushioned pillow substantially surrounding at least a portion of the aperture. A securement mechanism releasably secures the cushioned pillow to the first side surface of the base wherein the base is mountable over the webbing of the lounge chair such that the cushioned pillow supports the person's head in a reclining, face-down position.

20 Claims, 3 Drawing Sheets

FACE AND HEAD SUPPORTING DEVICE FOR USE WITH A LOUNGE CHAIR OR THE LIKE

BACKGROUND Of THE INVENTION

1) Field of the Invention

This invention relates generally to devices for supporting the face and the head of a user for use with a lounge chair or the like and, more particularly, it relates to devices for supporting the face and head of a user for use with a lounge chair or the like with the device supportingly engaging the face of a user and allowing the user to lie in a face down manner on the lounge chair while allowing the user's face to be substantially unobstructed.

2) Description of Known Art

For many years, relaxing in a lounge chair or on a beach towel, for instance, the beach, by a pool, or in a yard for sunbathing and/or reading has been a popular form of recreation. Typically, when relaxing in such a manner, the person positions himself or herself in a reclined position on either his or her back or front side particularly when it is desirous during sunbathing to allow the sun's rays to be exposed to nearly all portions of the body. Certain difficulties or disadvantages are normally encountered when the person wishes to "tan" his or her backside or to read in a face down manner. Such difficulties are generally associated with the structure of a lounge chair or the like when such is used and involves the general discomfort associated with such a position. Whether the person is supported on a beach towel on the ground or on a lounge chair, a problem exists with the location of the person's face and head in a desired normal position with a comfortable orientation which does not obstruct the breathing of the person. The general, recognized structure of a lounge chair generally does not allow the person's head to be properly oriented in a comfortable position for a prolonged period of time without either obstructing the breathing passages or otherwise putting undue pressure on the person's neck area so as to render the relaxing person uncomfortable.

Known art recognized problems as set forth above as evidenced by Finkelstein, U.S. Pat. No. 4,891,854. The Finkelstein patent describes a face and head support assembly for use with a lounge chair or like structure designed to be mounted on or used directly in combination with a lounge chair. In one embodiment, the support assembly is slipped over the end of a lounge chair with the vinyl straps of the chair being either removed or spread apart by hooks. Needless to say, removing the straps at a certain portion of the lounge chair basically means that the lounge chair will be damaged such that future use is hindered. When at a hotel or other resort, damaging or otherwise altering the lounge chair is not an option. Furthermore, use of hooks to spread the vinyl strips apart can also damage the lounge chair depending on the type and placement of the vinyl strips on the lounge chair and the hooks on the support assembly.

In another embodiment of the support assembly of the Finkelstein patent, the support assembly has a plurality of rod-like supports with a cushioned periphery attached thereto for confronting the face of the user when in a face-down reclined position. The rod-like supports are integrally or otherwise fixed to the frame of the lounge chair. Once again, at a hotel or other resort where the lounge chairs are constructed in such a manner as not to receive the Finkelstein patent's support assembly, the support assembly of the Finkelstein patent would not be able to be used.

Accordingly, in view of known art attempts, there is still a need for a supporting device designed to facilitate the "face-down" support and inclination of a person, when sunbathing and/or reading, which will support the head and face area but not obstruct the breathing passages and which will make the person much more comfortable when maintaining such a position for prolonged periods of time. Also, there is a need for a structure, which allows a normal posture without undue strain on the muscles, joints, and bones of the neck of the user.

Therefore, there remains a need for a face and head supporting device for use with a lounge chair or the like which is portable and easy to use.

There remains a need for a face and head supporting device for use with a lounge chair or the like which can be used with a variety of different types of lounge chairs without damaging or otherwise altering the lounge chair. There remains a need for a face and head supporting device for use with a lounge chair or the like which can easily and comfortably used by a user laying on the ground.

Still further, there remains a need for a face and head supporting device for use with a lounge chair or the which has a removable face and head supporting pillow allowing the supporting pillow to be removed for washing and cleaning purposes.

SUMMARY

The present invention provides a supporting device for supporting a person's head on a lounge chair. The lounge chair has a support frame and webbing secured within the support frame.

The supporting device of the present invention includes a substantially flat base with the base having a first side surface and a second side surface opposite the first side surface. The base further has an aperture through the first side surface and the second side surface with the aperture being sized and shaped to allow passage of a major portion of the user's face therethrough. A cushioned pillow is positioned adjacent the first side surface of the base with the cushioned pillow substantially surrounding at least a portion of the aperture. Securement means releasably secure the cushioned pillow to the first side surface of the base wherein the base is releasably mountably receivable within the webbing of the lounge chair such that the cushioned pillow supports the person's head in a reclining, face-down position.

In an embodiment of the present invention, the cushioned pillow of the supporting device comprises a resilient material. Preferably, the resilient material is a 100% polyester fiber filling. Preferably, the filling material of the pillow will be of a material which inhibits the growth of bacteria.

In an embodiment of the present invention, the resilient material of the cushioned pillow is closely covered by a covering. Preferably, the covering is a cloth fabric material. Most preferably the covering will be made from an all cotton fabric. Furthermore, it is preferred that the cover be closed such that the filling is not easily removed from the covering. However, it is contemplated the covering could include an opening that allows insertion and removal of the resilient material from the covering.

In yet another embodiment of the present invention, the securement means comprises at least a first fastening mechanism attached to the base and a corresponding second fastening mechanism attached to the cushioned pillow with the first fastening mechanism being received by or receiving the second fastening mechanism to releasably secure the cushioned pillow to the base. Preferably, the first fastening mechanism is either attached to the first side surface of the base or to the second side surface of the base. With this preferred arrangement the pillow or covering would attach directly to the base. However, it is contemplated that the supporting device could also include a fastening strap attached to the cushioning pillow with the fastening strap extending around the base from the first side surface to the second side surface. Furthermore, preferably the securement means is a snap with the first fastening mechanism comprising a male snap portion and the second fastening mechanism comprising a female snap portion.

The present invention further includes a method for supporting a person's head on a lounge chair with the lounge chair having a support frame and webbing secured within the support frame. The method of the present invention comprises first providing a substantially flat base having a first side surface and a second side surface opposite the first side surface. Next, an aperture is formed through the first side surface and the second side surface sized and shaped to allow passage of a major portion of the user's face therethrough. Then, a cushioned pillow is provided and positioned adjacent the first side surface of the base such that the cushioned pillow substantially surrounds at least a portion of the aperture. Next, the cushioned pillow is releasably secured to the first side surface of the base. Finally, the base is placed over the webbing of the lounge chair such that the cushioned pillow supports the person's head in a reclining, face-down position.

In an embodiment of the method of the present invention, the cushioned pillow comprises a resilient material. Preferably, the resilient material is 100% polyester fiber. In another embodiment of the method of the present invention, the method further comprises closely covering the resilient material with a cover material. Preferably, the cover material is a cloth fabric material, and most preferably a cotton material.

In yet another embodiment of the method of the present invention, the method further comprises forming an opening in the cover material. Preferably, the method further still comprises inserting and removing the resilient material into the cover material through the opening. Furthermore, preferably, the method comprises releasably closing the opening for inhibiting accidental removal of the resilient material from the cover material.

An important aspect of the method of the present invention, is the use of a generally circular pillow, preferably being in an arch shape of less than 360 degrees, which is releasably secured to the base by a fastening mechanism attached to the base. Preferably, the fastening mechanism is a snap. The generally circular shape of the pillow, when used with the base, allows support of the head when laying face down over the base, and when used apart from the base, allows support of the head by encircling the neck to support the head.

DETAILED DESCRIPTION OF PREFERRED EMBODIMENTS

Figure 1:
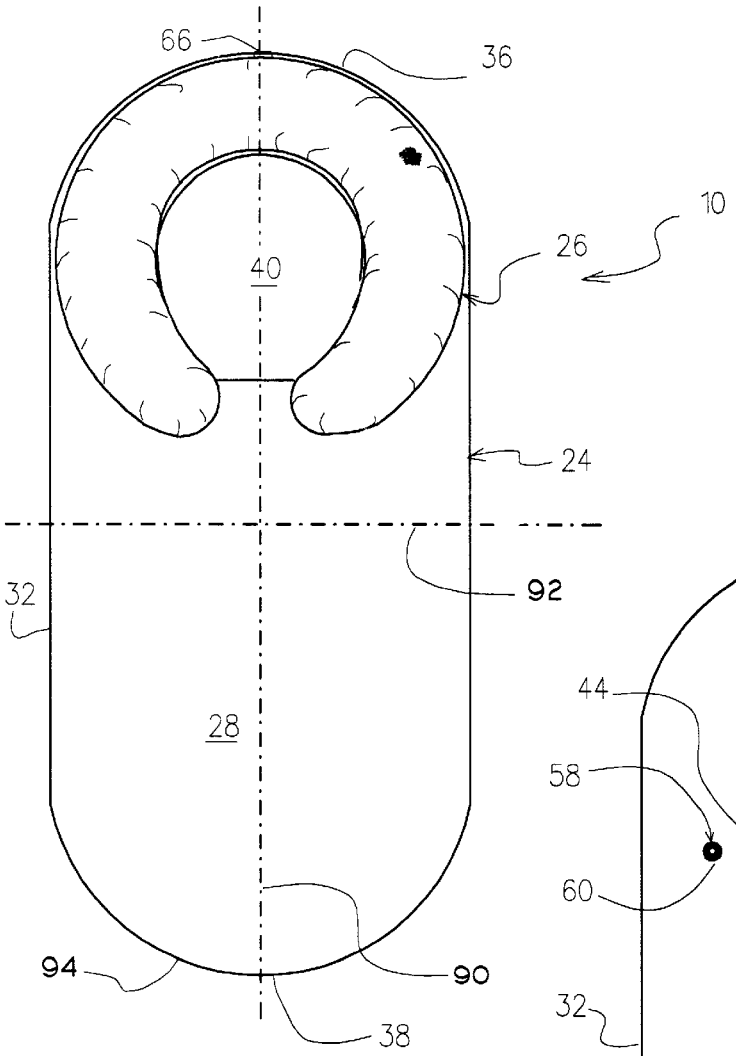
FIG. 1 is a front view illustrating an embodiment of a face and head supporting device for use with a lounge chair or the like constructed in accordance with the present invention.
Figure 6:
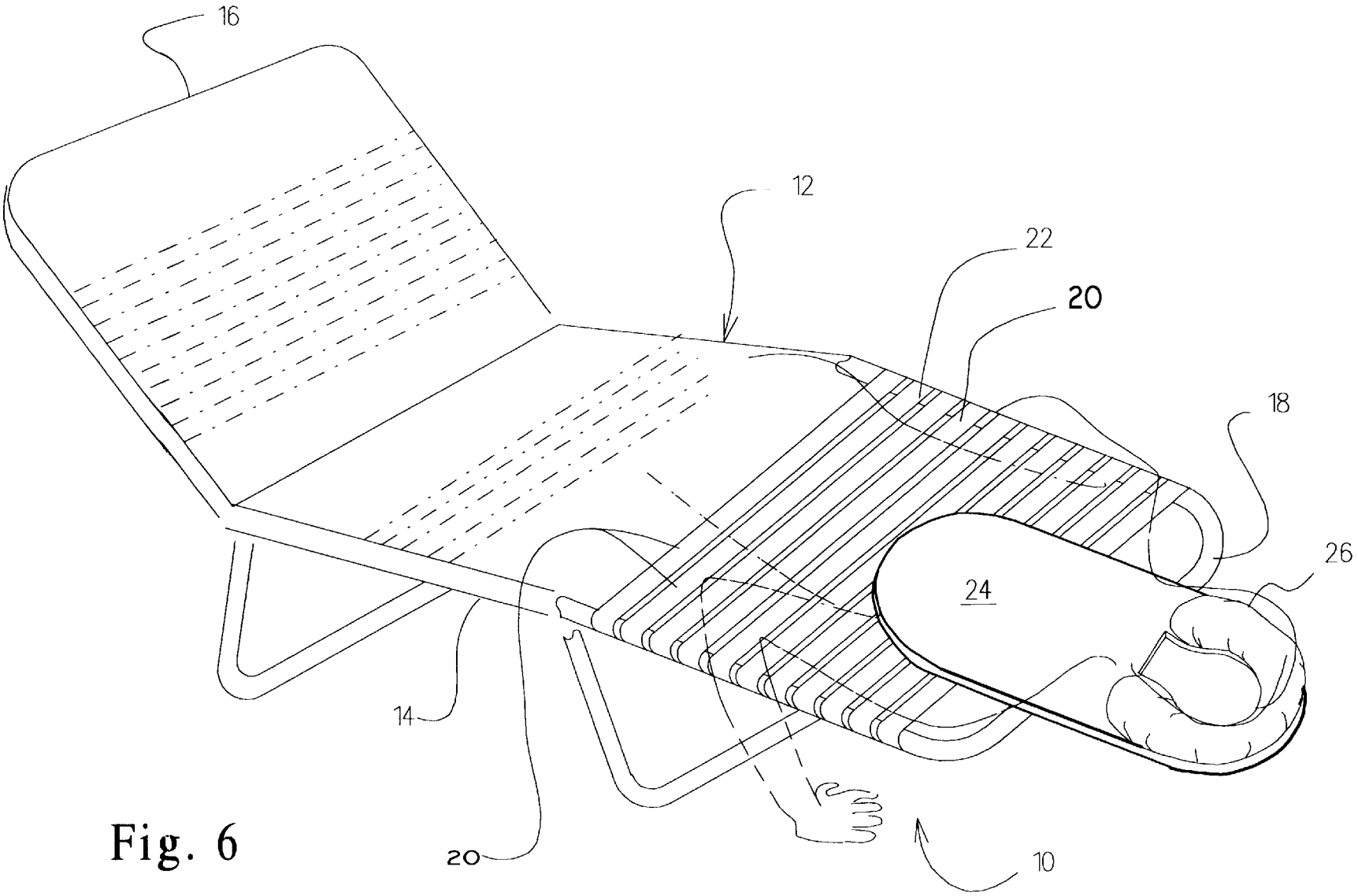
FIG. 6 is a top view illustrating the face and head supporting device for use with a lounge chair or the like constructed in accordance with the present invention in use on a typical lounge chair.

As illustrated in FIG. 1, the present invention is a face and head supporting device, indicated generally at 10, for use with a lounge chair 12 or the like. Typically, the lounge chair 12, as illustrated in FIG. 6, has a support frame 14 defining a head end 16 and a foot end 18, and a plurality of vinyl strips 20 forming a webbing 22 with the support frame 14 at the head end 16 and/or the foot end 18. While described as being constructed of vinyl strips 20, it is within the scope of the present invention to have the webbing 22 of the lounge chair 12 constructed from other materials. Similarly, it is contemplated that the instant invention can be used on chairs, loungers, benches or other supports that do not include webbing.

As illustrated in FIG. 1, the supporting device 10 of the present invention has a base 24 with a major axis 90 and a minor axis 92 that divide the perimeter 94 into substantially symmetrical sections, and a cushioned pillow 26 detachably attached to the base 24. The base 24 preferably has a length of approximately 20.3 inches, a width of approximately 8.5 inches, and a thickness of approximately 0.25 inch. It is within the scope of the present invention to have a base 24 with a greater or lesser length, a greater or lesser width, and/or a greater or less thickness. Furthermore, the base 24 is preferably constructed from a plastic material, however, it is within the scope of the present invention to construct the base 24 of the supporting device 10 of the present invention from other materials including, but not limited to, metal, aluminum, ceramic, etc.

Figure 2:
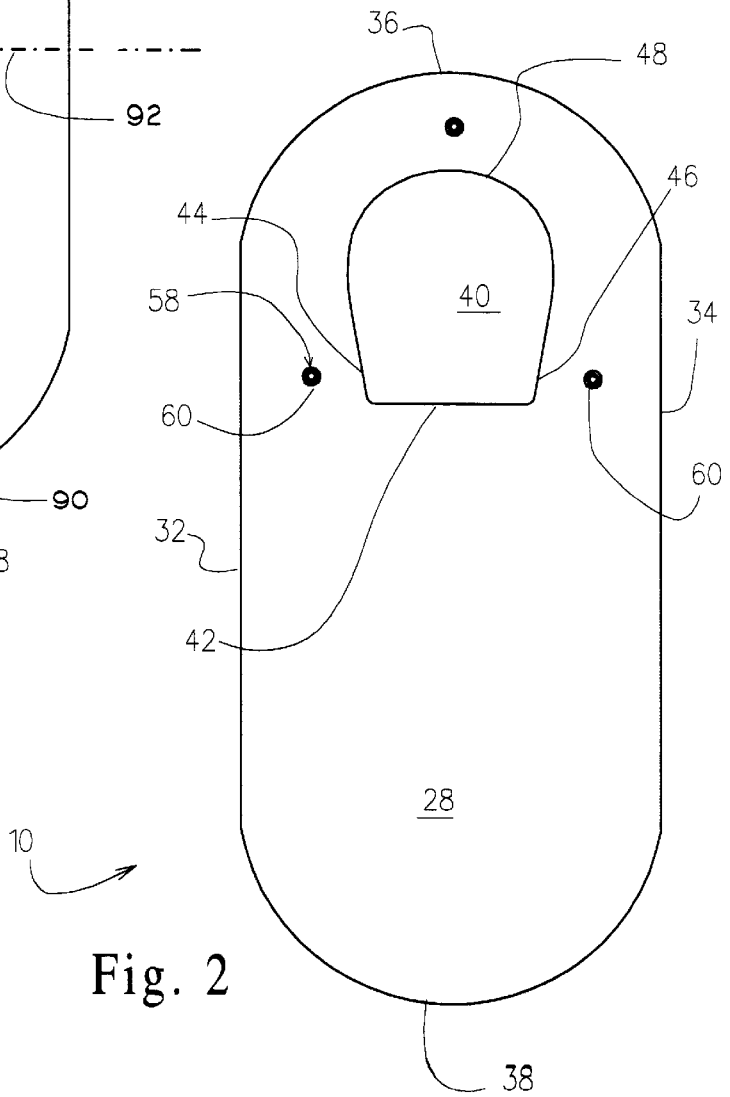
FIG. 2 is a rear view illustrating the embodiment as illustrated in FIG. 1 of the face and head supporting device for use with a lounge chair or the like constructed in accordance with the present invention.

The base 24 of the supporting device 10 of the present invention has a top side surface 28, a bottom side surface 30 (as illustrated in FIG. 2) opposite and substantially parallel to the top side surface 28, a first side edge 32, a second side edge 34 opposite and substantially parallel to the first side edge 32, and opposing first and second rounded end edges 36, 38 between the first and second side edges 32, 34. Preferably, both the top side surface 28 and the bottom side surface 30 are substantially smooth allowing easy and comfortable use with a lounge chair 12 or under a beach towel (not shown). Use of the supporting device 10 with a lounge chair 22 or under a beach towel will be described in further detail below.

The base 24 further has an aperture 40 formed through the top and bottom side surfaces 28, 30 between the first and second side edges 32, 34 nearingly adjacent the first rounded end edge 36. The aperture 40 is sized and shaped similar to the size and shape of a person's face (not shown) such that a person can easily view through the aperture 40 when the person's face is nearingly adjacent the aperture 40.

In a preferred embodiment of the supporting device 10 of the present invention the aperture 40 has a substantially mushroom shape having a substantially straight first edge 42, a rounded second edge 44 adjacent to and rounding away from the first edge 42 toward the first side edge 32 of the base 24, a rounded third edge 46 opposite the second edge 44 and adjacent to and rounding away from the first edge 42 toward the second side edge 34 of the base 24, and a rounded fourth edge 48 opposite the first edge 42 between the rounded second edge 44 and the rounded third edge 46 and rounding toward the first rounded end edge 36 of the base 24. The length of the aperture 40 is preferably approximately 6.2 inches, the width of the aperture 40 between the rounded second edge 44 and the rounded third edge 46 is preferably approximately 3.1 inches, and the width of the aperture 40 at the widest point is preferably approximately 4.5 inches. It is within the scope of the present invention to have the aperture 40 with a greater or lesser length and/or greater or lesser widths.

Figure 4:
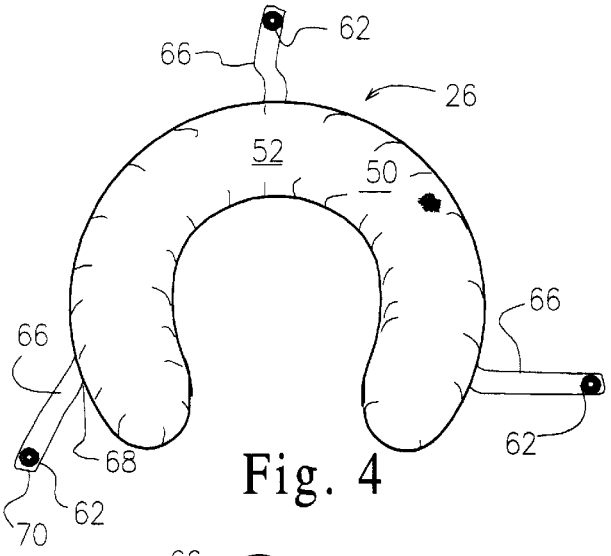
FIG. 4 is a front view illustrating the embodiment as illustrated in FIG. 1 of a cushioned pillow of the face and head supporting device for use with a lounge chair or the like constructed in accordance with the present invention.
Figure 5:
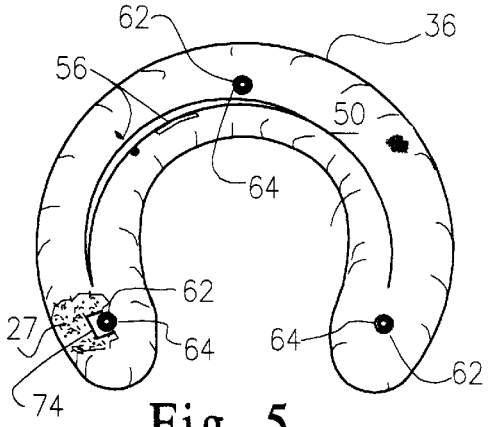
FIG. 5 is a rear view illustrating the cushioned pillow of FIG. 4 of the face and head supporting device for use with a lounge chair or the like constructed in accordance with the present invention.

The cushioned pillow 26 of the supporting device 10 of the present invention is preferably constructed from substantially horseshoe-shaped soft resilient material 27 having anti-bacterial properties, i.e., a 100% polyester fiber or foam or other soft material, sized to substantially surround the aperture 40 formed within the base. The soft resilient material is preferably closely surrounded by a cloth fabric cover 50, preferably of an all cotton fabric, having an outer surface 52. Although the preferred embodiment of the invention includes a sealed cloth fabric cover 50, as illustrated in FIG. 4, it is contemplated that the cloth fabric cover 50 may include an opening 54 formed therein for inserting and removing the soft resilient material rendering the cloth fabric cover 52 washable separate from the soft resilient material when necessary. It is contemplated that if an opening 54 is provided in the fabric cover 50, the opening 54 in the cloth fabric cover 50 is releasably closable around the soft resilient material by a closure 56, which may be a buttoned closure, hook and loop material closure such as the material sold under the trade mark Velcro, snaps, zippers or the like. It should be noted that while the cloth fabric cover 50 around the soft resilient material has been described heretofore as being cloth fabric, it is within the scope of the present invention to construct the cloth fabric cover 50 from other materials including, but not limited to, leather, vinyl, etc. Furthermore, rather than being constructed from a substantially horseshoe-shaped 100% polyester fiber or foam, it is within the scope of the present invention to have the soft resilient material constructed of multiple foam pieces or other non-unitary soft material releasably sealed within the cloth fabric cover. In this instance, it is preferable to have the cloth fabric cover 50 be substantially horseshoe shaped to substantially surround the aperture 40 in the base 24 as will be described in further detail below.

Figure 3:
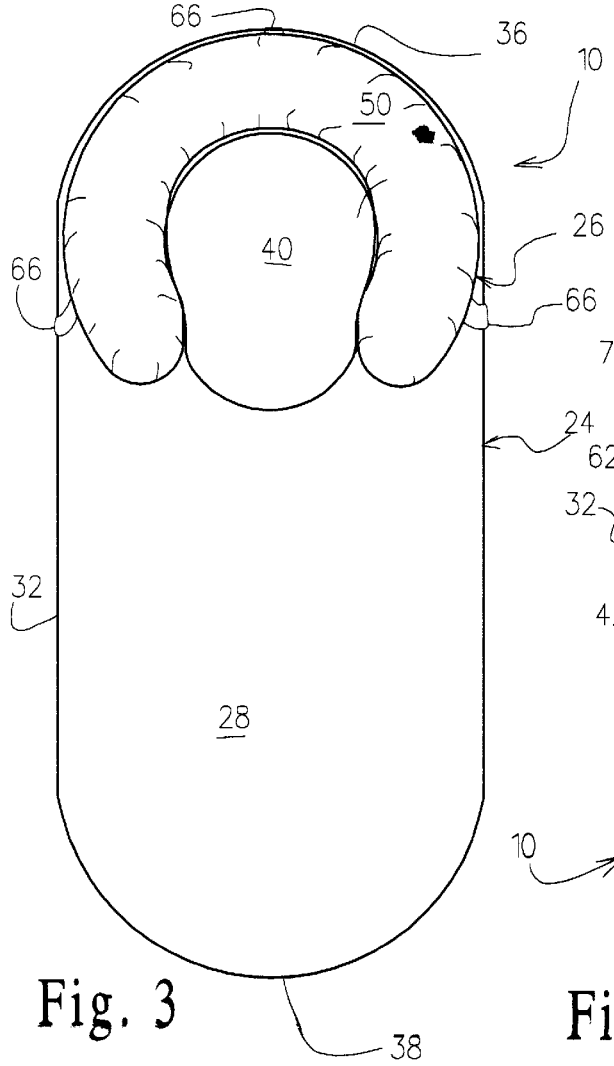
FIG. 3 is a front view illustrating another embodiment of a face and head supporting device for use with a lounge chair or the like constructed in accordance with the present invention.

As illustrated in FIGS. 2, 3 and 4, to releasably secure the cushioned pillow 26 to the base 24 of the supporting device 10, the base 24 and the cushioned pillow 26 have at least one mutually mating fastening mechanism 58 having a base fastening portion 60 and a pillow fastening portion 62. As illustrated in FIG. 2, the base fastening portion 60 the base 24 is preferably secured to the top side surface 23 of the base 24 and the pillow fastening portion 62 of the cushioned pillow 26 is preferably secured to the outer surface 52 of the cloth fabric cover 50 of the cushioned pillow 26. Preferably, the fastening mechanism 58 includes a plurality of snaps 64 with the male/female snap portion being releasably secured to the base 24 and the corresponding female/male portion being secured to the cushioned pillow 26. In a highly preferred embodiment of the invention the snaps 64 are attached to the fabric cover 50 with the use of a strong backing 74, which will reduce the possibility of having the snaps 64 tear away from the fabric cover 50. An important result achieved by making the pillow 26 removable is that the shape of the pillow 26 allows the pillow to be removed and placed around the user's neck and used independently as head support pillow. To take advantage of this function, it is preferred that the pillow 26 be attachable to the base 24 through small fasteners, such as snap fasteners.

Figure 7:
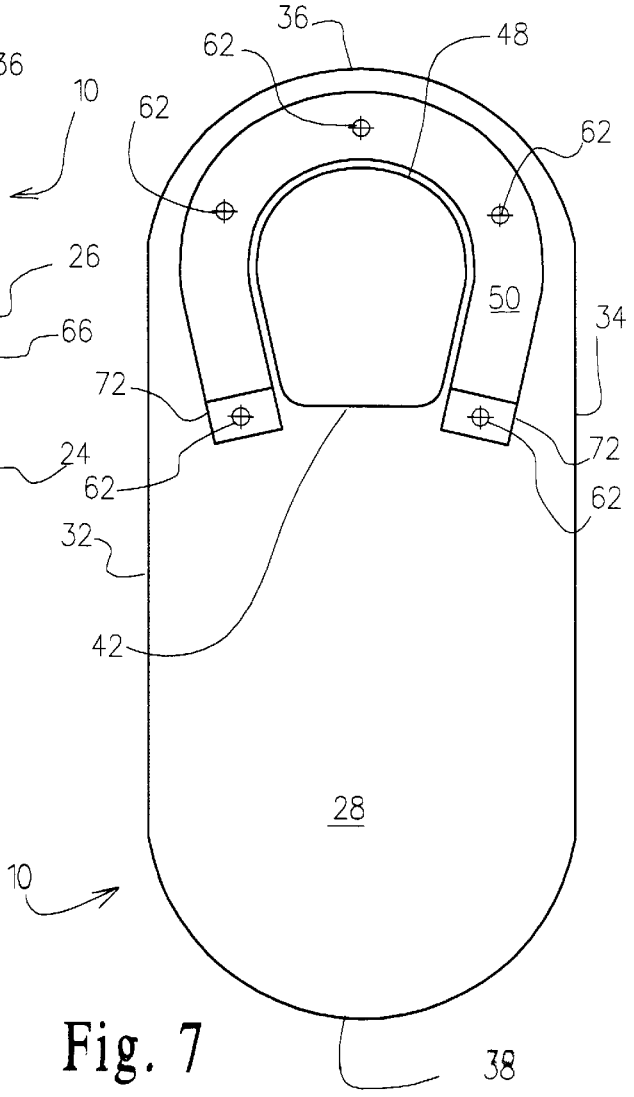
FIG. 7 is a top view illustrating yet another embodiment of the face and head supporting device for use with a lounge chair or the like constructed in accordance with the present invention.

In an embodiment of the invention, the cushioned pillow 26 has a pair of tabs 72, as best illustrated in FIG. 7, with each tab 72 having a pillow fastening portion 62 affixed thereto. In this embodiment of the supporting device 10, there are five base fastening mechanisms 60 on the base 24 and five corresponding pillow fastening mechanisms 62 on the cushioned pillow 26 assuring releasable attachment of the cushioned pillow 26 to the base 24 and inhibiting accidental dislodgment of the cushioned pillow 26 from the base 24. While the fastening mechanism 58 has been described heretofore as being snaps 64, it is within the scope of the invention to have the fastening mechanism 58 of the supporting device 10 of the present invention include, but not limited to, hook and loop fasteners, buttons, etc.

As illustrated in FIGS. 3 and 4, in yet another embodiment of the supporting device 10 of the present invention, the base fastening portion 60 of the base 24 is secured to the bottom side surface 30 of the base 24. In this embodiment, the cushioned pillow 26 has at least one fastening strap 66 having a secured end 68 and a free end 70. The secured end 68 of the fastening strap 66 is secured to the cloth fabric cover 50 by stitching or the like and extends from the cloth fabric cover 50 of the cushioned pillow 26 with a corresponding pillow fastening portion 62 secured to the free end 70 of the fastening strap 66. Further in this embodiment, the cushioned pillow 26 is releasably attached to the base 24 by extending the free end 70 of the fastening strap 66 about the second side edge 34, the third side edge 36, or the fourth side edge 38 of the base 24 and matingly connecting the pillow fastening portion 62 to the corresponding base fastening portion 60 on the base 24. In a variation of the invention, the supporting device 10, there are three fastening straps 66 extending from the cushioned pillow 26 with a pillow fastening portion 62 secured to the free end 70 of each fastening strap 66 with each mating with a corresponding base fastening portion 60 on the bottom side surface 30 of the base 24.

The detachable cushioned pillow 26 of the supporting device 10 of the present invention provides comfort and leisure for the user of the supporting device 10. By having the cushioned pillow 26 being detachable from the base 24, the cushioned pillow 26 can be used alone as a neck and/or head pillow for those instances in which a person chooses to recline and relax without the benefit of a lounge chair 12.

In operation of the supporting device 10 of the present invention, the cushioned pillow 26 is assembled with a sealed fabric cover 50 that is filled with a 100% polyester filling that allows laundering of the entire assembly is attached to the top side surface 28 of the base 24 by means of snap fasteners 64. However, in a variation of this preferred embodiment a soft resilient material is inserted into the cloth fabric cover 50 through the opening 54 in the cloth fabric cover 50. The opening 54 is then releasably secured in a closed position by the zipper 56 or other means thereby maintaining the soft resilient material within the cloth fabric cover 50. The cushioned pillow 26 is then releasably attached to the base 24 by the fastening mechanism 58 as described above. Next, the first side edge 32 of the base 24 is placed over the webbing 22 of the lounge chair 12. As illustrated in FIG. 6, the base 24 is positioned over the webbing 22 at the head end 16 or the foot end 18 of the lounge chair 12 until the cushioned pillow 26 is nearingly adjacent the support frame 14 of the lounge chair 12. If preferred, a beach towel or other cover can be positioned over the base 24. The person can then position himself or herself on the lounge chair 12 with his or her face resting on the cushioned pillow 26 of the supporting device 10 and with the upper torso of the user over the top side surface 28 of the base 24. This allows the person to read or otherwise conduct business through the aperture 40 of the base 24 with the beach towel inhibiting the person from actually feeling the base 24 of the supporting device 10 against his or her body.

The supporting device 10 of the present invention can also be used without a lounge chair 12. In addition to being able to detach the cushioned pillow 26 from the base 24 to use without a lounge chair 12, the supporting device 10 can be simply positioned upon a surface (not shown), such as the ground, and covered with a beach towel or the like. Due to the minimal thickness of the base 24 of the supporting device 10, the person using the supporting device 10 is inhibited from actually felling the base 24 of the supporting device 10 against his or her body.

The supporting device 10 of the present invention provides a novel and unique manner for a person to relax on or off a lounge chair 12 on his or her stomach in a comfortable and safe position. Furthermore, while being used on a lounge chair 12, the supporting device 10 allows a person to comfortably read through the aperture 40 in the base 24 of the supporting device 10 while in this position.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A supporting device for supporting a person's head next to a support for the body without securing, attaching, or fastening the supporting device to the support for the body, the supporting device comprising:

a substantially rigid flat base, the base having a generally oval, symmetrical perimeter having a major axis and a minor axis, the minor axis being shorter than the major axis and normal to the major axis, the minor axis dividing the perimeter into a front section and a rear section, the front section and the rear section each extending as substantially mirror images of each other about the minor axis, the base further having a top side surface and a flat bottom side surface that is free of any attachment means, the base further having an aperture through the top side surface that extends through the base to the bottom side surface, the aperture being sized and shaped to allow passage of a major portion of the user's face therethrough, the aperture being between the minor axis and the front section of the perimeter;

a cushioned pillow positioned over the top side surface of the base, the cushioned pillow substantially surrounding at least a portion of the aperture;

securement means for releasably securing the cushioned pillow to the top side surface of the base; and wherein the base is positionable below a person's torso while the cushioned pillow supports the person's head in a reclining, face down position.

2. The supporting device of claim 1 wherein the cushioned pillow comprises a resilient material.

3. The supporting device of claim 2 wherein the resilient material is of a polyester fiber.

4. The supporting device of claim 2 wherein the resilient material is closely covered by a covering.

5. The supporting device of claim 4 wherein the covering is a cloth fabric material.

6. The supporting device of claim 4 wherein the covering has an opening allowing insertion and removal of the resilient material.

7. The supporting device of claim 6 wherein the cushioned pillow is generally circular, so that the cushioned pillow may be removed from said base and placed around a person's neck to provide support for the person's head.

8. The supporting device of claim 1 wherein the securement means comprises at least a first fastening mechanism attached to the base and a corresponding second fastening mechanism attached to the cushioned pillow, the first fastening mechanism being received by or receiving the second fastening mechanism to releasably secure the cushioned pillow to the base.

9. The supporting device of claim 8 wherein the first fastening mechanism is attached to the top side surface of the base.

10. The supporting device on claim 9 and further comprising at least one fastening tab attached to the cushioned pillow, each fastening tab having a second fastening mechanism secured thereto.

11. The supporting device of claim 8 wherein the first fastening mechanism is attached to the bottom side surface of the base, the supporting device further comprising a fastening strap attached to the cushioned pillow, the fastening strap extending around the base from the top side surface to the bottom side surface.

12. The supporting device of claim 8 wherein the securement means is a snap, the first fastening mechanism comprising a male snap portion and the second fastening mechanism comprising a female snap portion.

13. A method for supporting a person's head from a lounge chair, the lounge chair having a support frame, the method comprising:

providing a substantially rigid flat base having a top side surface and a bottom side surface opposite the top side surface, the base being a generally oval, symmetrical perimeter having a major axis and a minor axis, the minor axis being shorter than the major axis and normal to the major axis, the minor axis dividing the perimeter into a front section and a rear section, the front section and the rear section being approximately mirror images about the minor axis, the bottom side surface of the base further being flat and free of any attachment means;

forming an aperture through the top side surface through to the bottom side surface, the aperture being a sized and shaped to allow passage of a major portion of the user's face therethrough;

providing a cushioned pillow;

positioning the cushioned pillow adjacent the top side surface of the base such that the cushioned pillow substantially surrounds at least a portion of the aperture;

releasably securing the cushioned pillow to the top side surface of the base; and mounting the base over a surface of the lounge chair such that the torso of the user's body retains the base over the frame while the cushioned pillow supports the person's head in a reclining, face-down position.

14. The method of claim 13 wherein the cushioned pillow comprises a resilient material.

15. The method of claim 14 wherein the resilient material is a polyester fiber.

16. The method of claim 14 and further comprising closely covering the resilient material with a cover material.

17. The method of claim 16 wherein the cover material is a cloth fabric material.

18. The method of claim 16 and further comprising forming an opening in the cover material, and further yet comprising inserting and removing the resilient material into the cover material through the opening.

19. The method of claim 13 wherein the cushioned pillow is releasably secured to the base by a fastening mechanism attached to the base and the cushioned pillow.

20. The method of claim 19 wherein the cushioned pillow is generally circular in shape and is releasably secured to the base, so that the cushioned pillow may be removed and placed about the person's neck to support the person's head.

* * * * *